US005407188A

United States Patent [19]

Ida et al.

[11] Patent Number: 5,407,188

[45] Date of Patent: Apr. 18, 1995

[54] CLASSIFYING TRAY APPARATUS

[75] Inventors: Masayuki Ida, Yamatokoriyama; Naoya Okamura, Nara, both of Japan

[73] Assignee: Sharp Kabushiki Kaisha, Osaka, Japan

[21] Appl. No.: 167,465

[22] Filed: Dec. 15, 1993

[30] Foreign Application Priority Data

Dec. 15, 1992 [JP] Japan ..... 4-334244

[51] Int. Cl.[6] ..... B65H 43/04

[52] U.S. Cl. ..... 271/215; 271/217; 271/224

[58] Field of Search ..... 271/213, 214, 215, 217, 271/224, 233, 248

[56] References Cited

U.S. PATENT DOCUMENTS

| | | | |
|---|---|---|---|
| 4,311,090 | 1/1982 | Dudziak et al. | 271/215 X |
| 5,215,300 | 6/1993 | Hiroi et al. | 271/217 X |
| 5,316,287 | 5/1994 | Hiroi et al. | 271/217 X |
| 5,318,401 | 6/1994 | Mandel | 271/217 X |

FOREIGN PATENT DOCUMENTS

| | | |
|---|---|---|
| 53-103279 | of 1978 | Japan . |
| 4-22826 | of 1992 | Japan . |

*Primary Examiner*—H. Grant Skaggs
*Assistant Examiner*—Carol L. Druzbick
*Attorney, Agent, or Firm*—David C. Conlin; George W. Neuner

[57] ABSTRACT

A classifying tray apparatus is provided with a plurality of sheet end receiving rollers for arranging each rear end portion of the sheets stacked on a sheet discharge tray. Each sheet end receiving roller stands rotatably on a main body of the classifying tray apparatus so as to rotate, in accordance with the horizontal movement of the sheet discharge tray in a direction perpendicular to a discharge direction, while being in contact with the sheets stacked on the sheet discharge tray or with the sheet discharge tray, thereby avoiding the unevenness of the sheets stacked on the sheet discharge tray.

16 Claims, 14 Drawing Sheets

CLASSIFYING TRAY APPARATUS

BACKGROUND OF THE INVENTION

1. Field of the Invention

The present invention relates to a classifying tray apparatus wherein the sheets, discharged from an image forming apparatus such as a copying machine and printing machine, are classified and stacked by a sheet discharge tray that can move from side to side and can elevate.

2. Description of the Prior Art

In a conventional classifying tray apparatus having the classifying function, a sheet discharge tray is provided at a predetermined distance under a sheet discharging portion for discharging the sheet, the sheet discharge tray having a surface which is inclined upward in an outer direction such that the sheet discharge tray is drived to move in a direction perpendicular to a discharge direction (hereinafter referred to as a right-to-left direction).

The sheet discharged from the sheet discharging portion falls onto the sheet dischage tray which has been moved to either the left or right. Then, the discharged sheet is slipped downward on the sheet discharge tray due to the sheet own weight so as to be arranged by coming into contact with a sheet end receiving member which is located at a rear end of the sheet discharge tray, thereby enabling of classification and stacking.

In such classifying tray apparatus, a falling distance of the top sheet on the sheet discharge tray is different from that of the bottom sheet to be stacked on the sheet discharge tray after stacking many sheets. The falling distance indicates a distance between the sheet discharging portion and the top sheet stacked on the sheet discharge tray. For example, the first discharged sheet on the sheet discharge tray and the 200th discharged sheet have respective different falling distance with each other.

Thus, the discharged sheet slides on the sheet discharge tray which has the surface inclined upward or slides on the top sheet stacked on the sheet discharge tray, and each rear end of the slid sheets comes into contact with the sheet end receiving member so as to stop moving. During such process, the discharged sheet deviates in a right-to-left direction with respect to the sheet discharge direction. Accordingly, the tendency of the sheets stacked on the sheet discharge tray is such that the upper sheets are in good order while the lower sheets are of unevenness.

There is known an apparatus wherein a vibration proof rubber is fixed to the sheet end receiving member such that the sheet deviation due to the bound after coming into contact with the sheet end receiving member can be avoided. Such apparatus can improve a little in the degree of unevenness. However, it often occurs that the lower sheets on the sheet discharge tray are still uneven.

There is known another apparatus wherein the sheet discharge tray is moved up and down in accordance with the stacked height of sheets so as to make the falling distance even. However, when the stacked height of sheets becomes higher, there occurs resistance between the sheet and the sheet end receiving member during moving of the sheet discharge tray in the right-to-left direction, thereby presenting the problem that the sheets do not follow up the movement of the sheet discharge tray in the right-to-left direction so as to cause the stacked sheets to be uneven in the right-to-left direction.

The unevenness of the stacked sheets has been avoided in the following manner disclosed in the Japanese examined patent publication No. 4-22826 (1992). More specifically, there is provided a sheet end receiving member made of plate (hereinafter referred to as plate sheet end receiving member) which is movable in a right-to-left direction such that a sheet discharge tray moves in the right-to-left direction according to the movement of the plate sheet end receiving member in the right-to-left direction, thereby avoiding the occurrence of resistance between the sheet and the plate sheet end receiving member during moving of the sheet discharge tray in the right-to-left direction.

However, according to the conventional structure, since the sheet discharge tray and the sheet end receiving member integrally move, the total weight of members to move in the right-to-left direction becomes great, thereby requiring a great driving force for moving the members in the right-to-left direction. Further, the conventional structure requires a space inside the main body of the apparatus for moving the sheet end receiving member in the right-to-left direction.

SUMMARY OF THE INVENTION

It is an object of the present invention to provide a classifying tray apparatus for avoiding by simple structure an unevenness of the sheets which are classified and stacked on a sheet discharge tray.

In order to achieve the foregoing object, the classifying tray apparatus of the present invention is arranged so as to have: (1) a plurality of discharge means for respectively discharging sheets; (2) a sheet discharge tray, provided under said discharge means, for stacking the sheets discharged from said discharge means, said sheet discharge tray having a shape of inclined upward in the discharge direction of the sheets; (3) a plurality of sheet end receiving rollers for respectively arranging each rear end portion of the sheets stacked on said sheet discharge tray; and (4) moving means for horizontally moving said sheet discharge tray in a direction perpendicular to the discharge direction of the sheet, wherein each of said sheet end receiving rollers rotatably stands on a classifying tray apparatus main body such that an axial direction of said each sheet end receiving roller coincides with an up-and-down direction, and rotates while being in contact with said sheet discharge tray or with the stacked sheets, in accordance with horizontal movement of said sheet discharge tray by the moving means.

With the arrangement, the sheets discharged from the plurality of discharge means fall onto the sheet discharge tray so as to be arranged by coming into contact with the sheet end receiving rollers due to the respective own weights.

When the sheet discharge tray horizontally moves in order to classify the discharged sheets, each sheet end receiving roller rotates in accordance with either the movement of the sheet discharge tray or the movement of the sheet stacked on the sheet discharge tray, thereby resulting in that the resistance of the sheet which is given by the sheet end receiving rollers becomes small. So, each sheet can smoothly move and no unevenness of the sheets stacked on the sheet discharge tray is occured, thereby ensuring the stable stacking and classification operations.

The simple structure wherein the sheet end receiving rollers are rotatably supported by the classifying tray apparatus main body is adopted in the present invention. So, during horizontal movements of the sheet discharge tray, the driving force for moving the sheet discharge tray in the right-to-left direction becomes smaller than that of the conventional case where the sheet end receiving member should also be moved. This causes to reduce the space required for the movement of the sheet discharge tray and the required parts number, thereby providing the compact apparatus.

The classifying tray apparatus of the present invention may be provided with driving means which is located in an end portion of the sheet end receiving roller so that the driving means rotates the sheet end receiving rollers in synchronization with the horizontal movement of the sheet discharge tray. With the arrangement, the resistance of the sheet which is given by the sheet end receiving rollers becomes small, thereby resulting in that each sheet can smoothly move.

By the way, in the case where the sheets are discharged so as to fall, when the sheets come into contact with the discharge means, it may happen that the sheet returns in the opposite direction to the discharge direction. However, since the sheet end receiving rollers of the present invention are provided under a sheet discharge side of the discharge means, the sheets fall along the sheet end receiving rollers, thereby avoiding that the sheets are deviated and are caught by the discharge means.

The classifying tray apparatus of the present invention may be further provided with covers between the respective adjoining sheet end receiving rollers. With the arrangement, it can be avoided that the sheet is caught between the adjoining sheet end receiving rollers.

The present invention may be arranged so that a belt is bridged between the adjoining sheet end receiving rollers. With the arrangement, during the horizontal movement of the sheet discharge tray, the rear end portion of the sheet is area-contact with the belt so that the belt moves in a right-to-left direction, thereby reducing the resistance of the sheet which is given by the belt. So, the sheet can smoothly move, and it can be avoided that the sheet is caught between the sheet end receiving rollers, thereby ensuring that (1) the sheets are unevenly arranged, and (2) the sheet is caught by the sheet end receiving rollers.

Since the rear end portion of sheet comes into area-contact with the belt, the damage in the rear end portion of the sheet becomes smaller than that of the case where the rear end portion of sheet comes into point-contact with the sheet end receiving roller, thereby resulting in that the rear end portion of sheet is hard to be damaged. This is a superior feature of the present invention.

DETAILED DESCRIPTION OF THE PREFERRED EMBODIMENTS

The following description deals with one embodiment of the present invention with reference to FIGS. 1 through 5.

Figure 2:
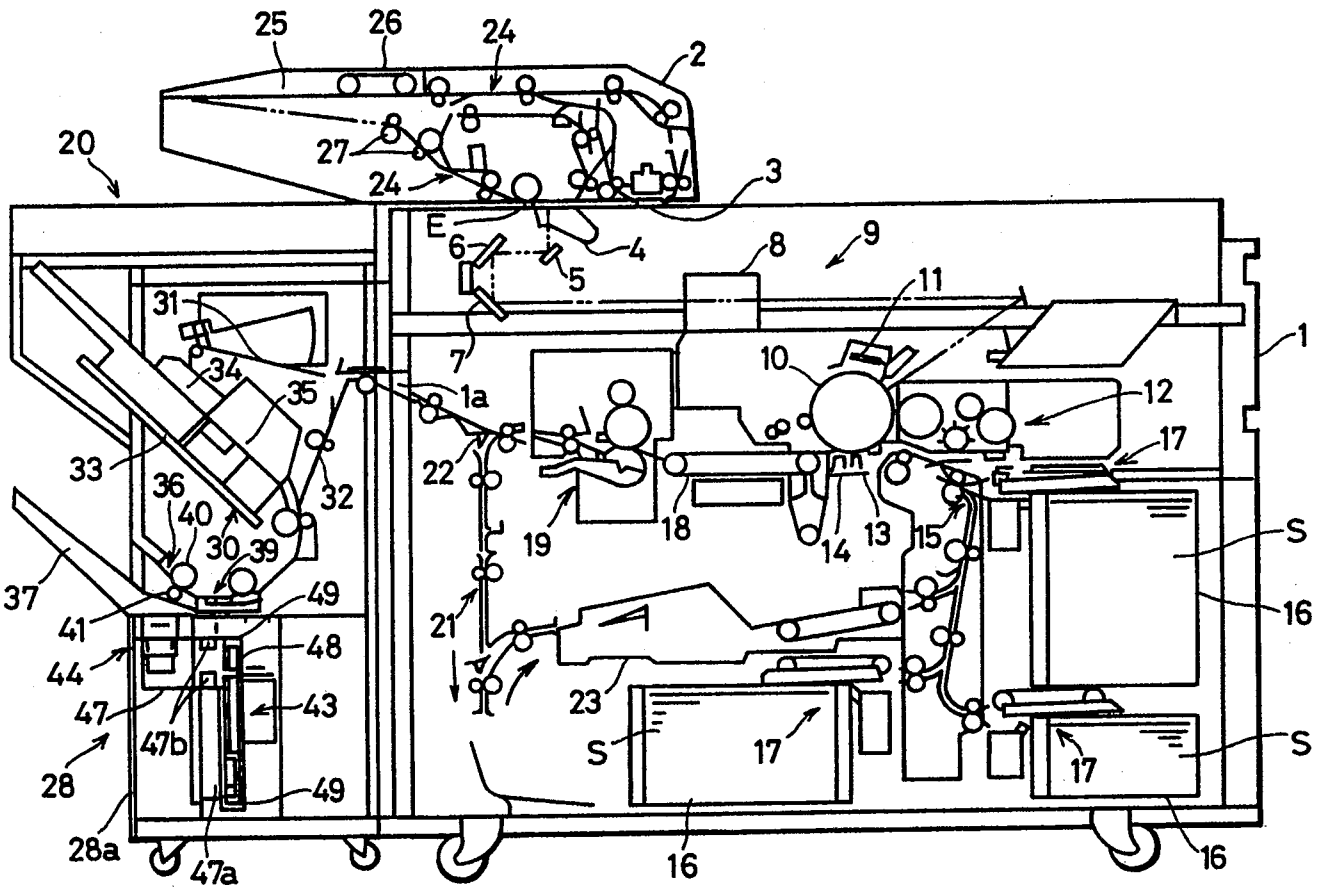
FIG. 2 is a longitudinal sectional view showing the structure of a copying machine having the classifying tray apparatus.

A copying machine having a classifying tray apparatus in accordance with the present embodiment is provided with a document feeder 2 on a copying machine main body 1 (see FIG. 2). The copying machine main body 1 is provided in its upper portion with an exposure glass 3 constituting an exposure section E. There is provided under the exposure glass 3 an optical system 9 composed of a light source lamp 4, mirrors 5, 6 and 7, and a lens 8.

The optical system 9 carries out scanning with respect to a document, which is fed to the exposure section E by the document feeder 2, in accordance with the projected light from the light source lamp 4. The reflected light from the document is directed to an exposure point on a front surface of a photosensitive drum 10 through the respective mirrors 5 to 7, and lens 8, thereby forming on the front surface of the photosensitive drum 10 an electrostatic latent image in accordance with the document image.

There is provided, around the photosensitive drum 10, a main charger 11 for charging the front surface of the photosensitive drum 10 with a predetermined electric potential, a developer 12, a transfer charger 13, and a separating charger 14.

The electrostatic latent image formed on the front surface of the photosensitive drum 10 is developed as a toner image by the developer 12. The toner image is transferred to a sheet S by the transfer charger 13. Thereafter, the tsheet S with the ransferred toner image is exfoliated from the photosensitive drum 10 by the separating charger 14.

There is provided, under the photosensitive drum 10, a sheet feeding path 15 for feeding the sheet S to which the toner image is transferred. In an upper stream of the sheet feeding path 15, there is provided sheet feeders 17 for feeding the sheet S from respective sheet feeding decks 16. The sheet S contained in each sheet feeding deck 16 is fed to the photosensitive drum 10 through the sheet feeding path 15. In a lower stream of the sheet feeding path 15, there is provided a feeding belt 18 for feeding the sheet S to which the toner image is transferred, and a fuser 19 for fixing the toner image onto the sheet S.

In a lower stream of the fuser 19, there is provided a deflector 22 for feeding the sheet S toward an aftertreatment device 20 and toward a re-feeding path 21. The re-feeding path 21 forms a circulating path through which the sheet S, to which the toner image is transferred by the photosensitive drum 10, is fed again to the photosensitive drum 10. In the course of the re-feeding path 21, there is provided an intermediate tray 23 for enabling of double-sided copy of the sheet S.

The document feeder 2 is provided with a document feeding path 24 for feeding the document to the exposure section E on the upper surface of the copying machine main body 1. The document feeding path 24 forms a circulating path, and in the circulating path a document tray 25 for stacking the documents, a feeding belt 26 for feeding the document on the document tray 25 to the exposure section E one after another, a plurality of transfer rollers 27 for feeding the sheet S to the exposure section E.

A sheet discharge opening 1*a* side of the copying machine main body 1 is connected with the aftertreatment device 20 and a classifying tray apparatus 28. The aftertreatment device 20 is provided with (1) an aftertreatment feeding path 31 for feeding the sheet S to an aftertreatment section 30 which is provided for carrying out a staple processing with respect to the sheet S, and (2) an untreated feeding path 32 for feeding the sheet S without the staple processing.

The aftertreatment section 30 is provided with a sheet receiving plate 33 for temporarily holding the sheets S, a jogger 34 for arranging the sheets S on the sheet receiving plate 33, and a stapler 35 for carrying out staple processing with respect to the sheet S. The sheets S to which no treatment or the staple processing has been carried out are discharged to a sheet discharge tray 37 by a plurality of discharge means 36, and are stacked so as to be classified by the classifying tray apparatus 28.

The discharge means 36 is composed of (1) a plurality of upper discharge rollers 40 which are provided in the vicinity of a sheet discharge portion 39 and (2) a plurality of lower follow-up rollers 41 which rotate in accordance with the discharge rollers 40.

Figure 1:
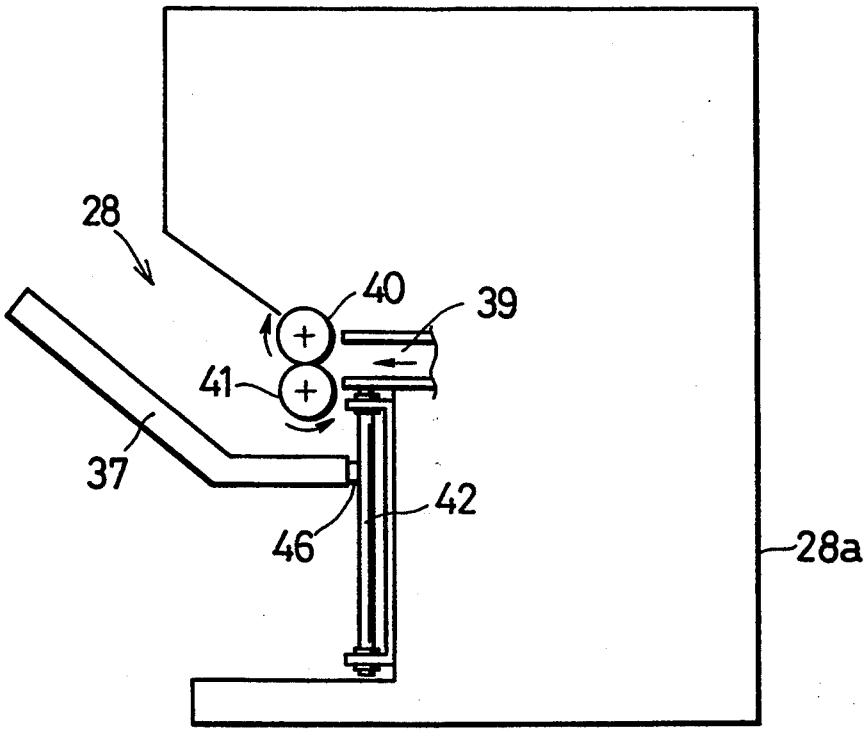
FIG. 1 is a structural diagram showing a classifying tray apparatus of a first embodiment in accordance with the present invention.

The classifying tray apparatus 28, as shown in FIGS. 1 and 2, is provided with the sheet discharge tray 37, a plurality of sheet end receiving rollers 42, an elevating means 43, and a moving means 44. The sheet discharge tray 37 is provided under the discharge rollers 40 and has a shape of inclined upward in the discharge direction of the sheet S so that the sheets S from the discharge rollers 40 are stacked. The sheet end receiving rollers 42 arrange rear ends of the respective sheets S which are stacked on the sheet discharge tray 37. The elevating means 43 moves the sheet discharge tray 37 along the sheet end receiving rollers 42. The moving means 44 horizontally moves the sheet discharge tray 37 in the right-to-left direction along the sheet end receiving rollers 42.

Figure 3:
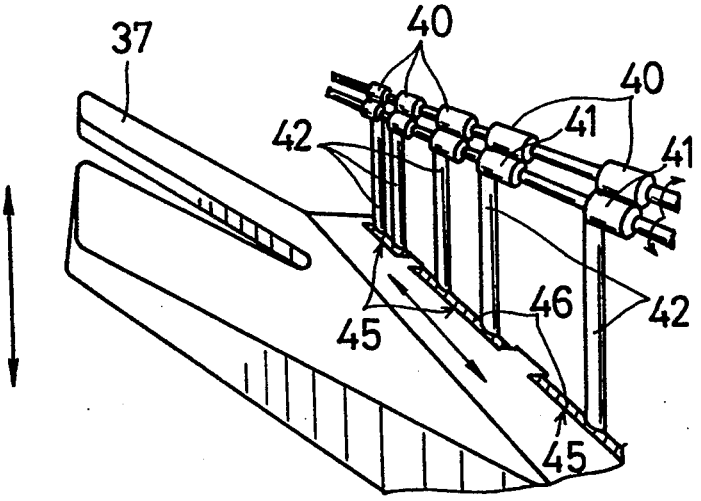
FIG. 3 is a perspective illustration showing a sheet discharge tray and sheet end receiving rollers.
Figure 4:
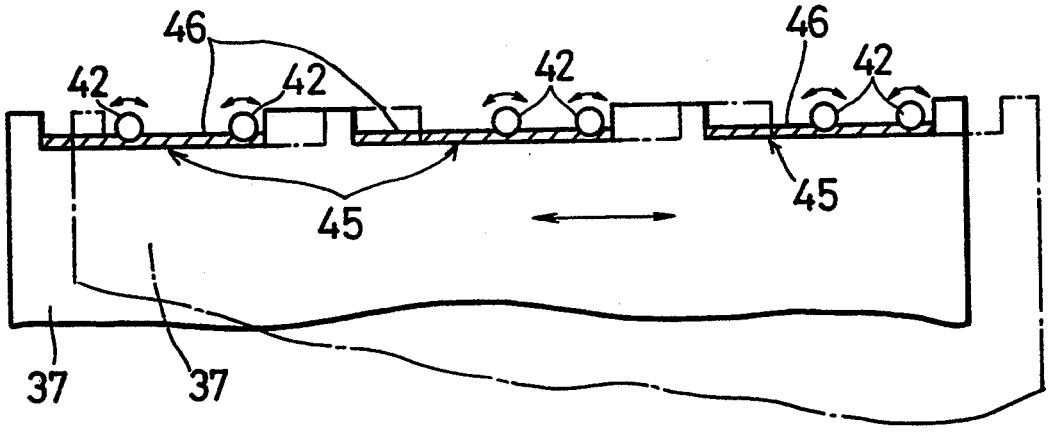
FIG. 4 is a plan view showing a state where the sheet discharge tray moves in a right-to-left direction.

An end portion of the sheet discharge tray 37 on the sheet end receiving roller 42 side is provided with a plurality of notches 45 for sheltering the sheet end receiving rollers 42 during elevating and horizontally moving of the sheet discharge tray 37 (see FIGS. 3 and 4). A cushion 46 (elastic member) made of strap sponge rubber is adhered to each notch 45.

Each sheet end receiving roller 42 is made of metal, and its axial direction coincides with an up-and-down direction. The sheet end receiving roller 42 is provided beneath the follow-up toiler 41 through the notches 45 of the sheet discharge tray 37 so as to rotatably stand on a classifying tray apparatus main body 28*a*, and has a length falling within a range wherein the sheet discharge tray 37 can elevate. The sheet end receiving roller 42 rotates while being in contact with the cushion 46 of the sheet discharge tray 37 during horizontal movement of the sheet discharge tray 37.

The elevating means 43, as shown in FIG. 2, is composed of (1) a supporter 47 for supporting the sheet discharge tray 37 so as to freely move in the right-to-left direction, (2) an elevating-use belt 48 which is fixed to the supporter 47, (3) a pair of upper and lower rollers 49 around which the elevating-use belt 48 is wound and is rotatably supported by the classifying tray apparatus main body 28*a*, and (4) a driving motor (not shown) for driving one of the rollers 49 so as to rotate.

The supporter 47 is guided in the up-and-down direction by a guide roller 47*b* to a guide 47*a* which is provided in the classifying tray apparatus main body 28*a* in the up-and-down direction.

The moving means 44 is composed of (1) a pinion, attached to the supporter 47, which engages a rack attached to the sheet discharge tray 37 and (2) a driving motor for driving the pinion through gears or other members so as to rotate. The members (1) and (2) (not shown) are provided in the supporter 47. An upper portion of the classifying tray apparatus main body 28*a* is provided with a photosensor of reflection-type which detects a distance in the up-and-down direction between the follow-up roller 41 and the top sheet S stacked on the sheet discharge tray 37. A control section 50 is provided for the drive controlling of elevating means 43 in response to a detected signal from the photosensor so as to keep an optimum distance, during discharging the sheets S, by which the sheets S are stacked in good order on the sheet discharge tray 37.

Figure 5:
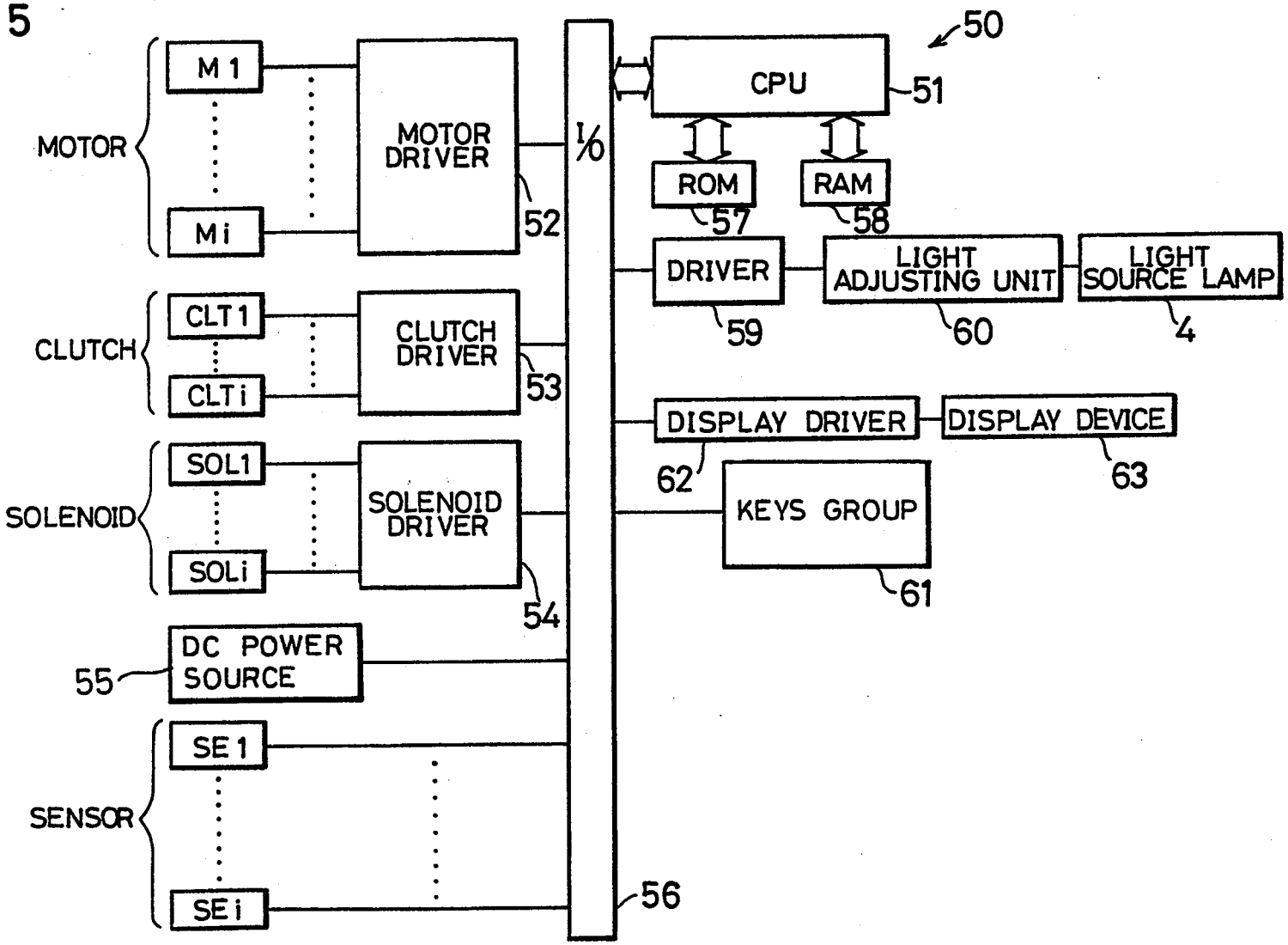
FIG. 5 is a block diagram showing a control section.

The control section 50 has a CPU 51, and controls the copying machine main body 1 and the document feeder 2 so as to be related to each other (see FIG. 5).

A plurality of motors M1 to Mi are connected with a motor driver 52. The motors M1 to Mi drive the rotating members such as the transfer rollers and sheet feeding rollers of the respective photosensitive drum 10, the copying machine main body 1 and document feeder 2. A plurality of clutches CLT1 to CLTi for intermittently driving the respective sheet feeders 17 and other devices are connected with a clutch driver 53. A plurality of solenoides SOL1 to SOLi for driving each deflector 22 and other devices are connected with a solenoid driver 54.

Controlling elements, such as the drivers 52, 53 and 54, a DC power source 55, and a plurality of sheet detecting sensors SE1 to SEi for detecting that the sheet and document have passed through a predetermined position, for controlling the document transfer, sheet transfer, and a plurality of processes are respectively connected with an interface circuit 56.

The interface circuit 56 is connected with the CPU 51. The interface circuit 56 outputs the detected signals of the sheet detecting sensors SE1 to SEi to the CPU 51, while controls the drivers 52, 53 and 54 so as to operate in response to the controlling signal from the CPU 51.

The CPU 51 is respectively connected with a ROM (Read Only Memory) 57 and a RAM (Random Access Memory) 58, and carries out the controllings in accordance with the program which is preliminarily stored in the ROM 57. Such controllings contain copying procedures for controlling of respective single-sided copy and double-sided copy.

In contrast, the RAM 58 is used as a buffer memory, a calculating area for counters, timers and flugs required for controlling of the copyings, and other areas.

The light source lamp 4 is connected with the interface circuit 56 through the driver 59 and a light adjusting unit 60. A keys group 61 for operations is further connected with the interface circuit 56, and a display device 63 is connected with the interface circuit 56 through a display driver 62.

With the arrangement, the sheets S, without the staple processing or with the staple processing, which are discharged from the discharge rollers 40 and the follow-up rollers 41 fall onto the sheet discharge tray 37 which has been moved toward the left or right. The sheet S is slipped downward due to its own weight so as to be arranged by coming into contact with the sheet end receiving rollers 42.

If the sheet S comes into contact with the follow-up roller 41 during falling of the sheet S, the sheet S returns in the opposite direction to the discharge direction due to the rotation of the follow-up roller 41. However, since each sheet end receiving roller 42 is provided beneath the corresponding follow-up roller 41, the sheet S falls along the sheet end receiving roller 42, thereby avoiding that the sheet S is stacked with inclined and is caught by the follow-up rollers 41.

The sheets S discharged one after another to the sheet discharge tray 37 are similarly arranged. Each time of the arrangement, the photosensor detects the distance between the follow-up roller 41 and the top sheet S stacked on the sheet discharge tray 37, and the sheet discharge tray 37 is moved downward in accordance with the detected results so as to keep the optimum distance.

The sheet discharge tray 37 is alternately moved in the horizontal direction between the right and left so that the sheets S discharged to the sheet discharge tray 37 are stacked by a predetermined number of the sheets on different positions corresponding to each copying content. During the horizontal movement of the sheet discharge tray 37, the sheet end receiving rollers 42 rotate in accordance with the movement of the sheet discharge tray 37, the sheet end receiving rollers 42 moving while being in contact with the cushion 46 adhered to the sheet discharge tray 37.

As mentioned above, the sheets S discharged to the sheet discharge tray 37 come into contact with the sheet end receiving rollers 42 so as to arrange each rear end of the sheets S. Further, since the sheet end receiving rollers 42 rotate in accordance with the horizontal movement of the sheet discharge tray 37 in the right-to-left direction, no resistance, which is derived from the sheet end receiving rollers 42, is given to the moving of sheet S in the right-to-left direction, thereby smoothly moving the sheet S.

Additionally, since a contacting area between the rear end of the sheet S and the sheet end receiving rollers 42 is small, a resistance of the sheet S due to the sheet end receiving rollers 42 is small during moving up and down of the sheet discharge tray 37, thereby smoothly moving up and down the sheet S. Accordingly, no unevenness occurs among the sheets S stacked on the sheet discharge tray 37, thereby ensuring the stable stacking and classification.

According to the simple structure wherein only the sheet end receiving rollers 42 are rotatably supported by the classifying tray apparatus main body **28*a*, it is necessary to move only the sheet discharge tray 37 when moving of the sheet discharge tray 37 in the right-to-left direction. Thus, the driving force for the moving of the sheet discharge tray 37** in the right-to-left direction becomes smaller than that of the conventional case where the sheet end receiving member should also be moved, thereby reducing the space required for the moving.

Figure 6:
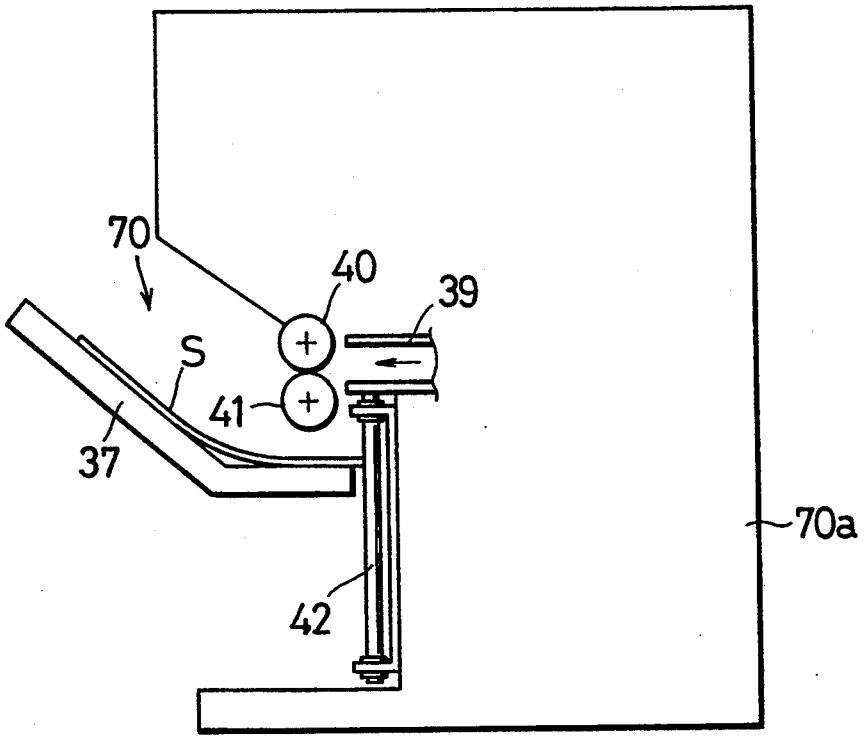
FIG. 6 is a schematic longitudinal sectional view showing the structure of a classifying tray apparatus of another embodiment in accordance with the present invention.
Figure 7:
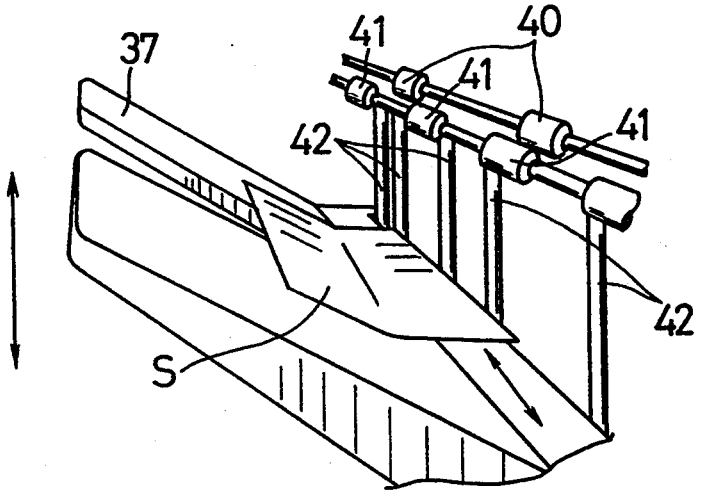
FIG. 7 is a perspective illustration showing a sheet discharge tray and sheet end receiving rollers of the second embodiment.
Figure 8:
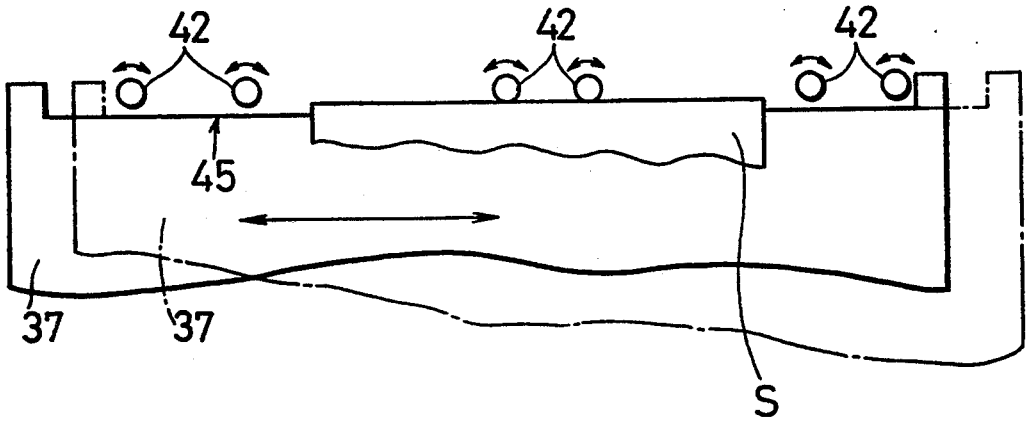
FIG. 8 is a plan view showing a state where the sheet discharge tray moves in a right-to-left direction.

The following description deals with another embodiment in accordance with the present invention with reference to FIGS. 6 through 8. Note that the same reference numerals are given to the members which have the similar functions to those of the foregoing embodiment, and the detail explanations are omitted.

In a classifying tray apparatus 70 of the present embodiment, as shown in FIG. 6, sheet end receiving rollers 42 stand rotatably on a position which is away in the opposite direction to the discharge direction from a sheet discharge tray 37. The sheet end receiving rollers 42 are supported on a classifying tray apparatus main body **70*a* so as to be rotated by small torques. As shown in FIG. 7, the sheets S stacked on the sheet discharge tray 37 are arranged based on the fact that each rear end of the sheets S comes into contact with the sheet end receiving rollers 42**.

With the arrangement, as shown in FIG. 8, the sheet end receiving rollers 42 rotate in accordance with the movement of the sheet S stacked on the sheet discharge tray 37 during horizontal movement of the sheet discharge tray 37 in the right-to-left direction. Other arrangements and operations are similar to those of the foregoing embodiment.

Since the sheet end receiving rollers 42 can be thus rotated by the small torques in accordance with the horizontal movement of the sheet S in the right-to-left direction, no resistance is given to the sheets S during moving in the right-to-left direction, thereby smoothly moving the sheets S. Accordingly, no unevenness occurs among the sheets S stacked on the sheet discharge tray 37, thereby ensuring the stable stacking and classification.

Figure 9:
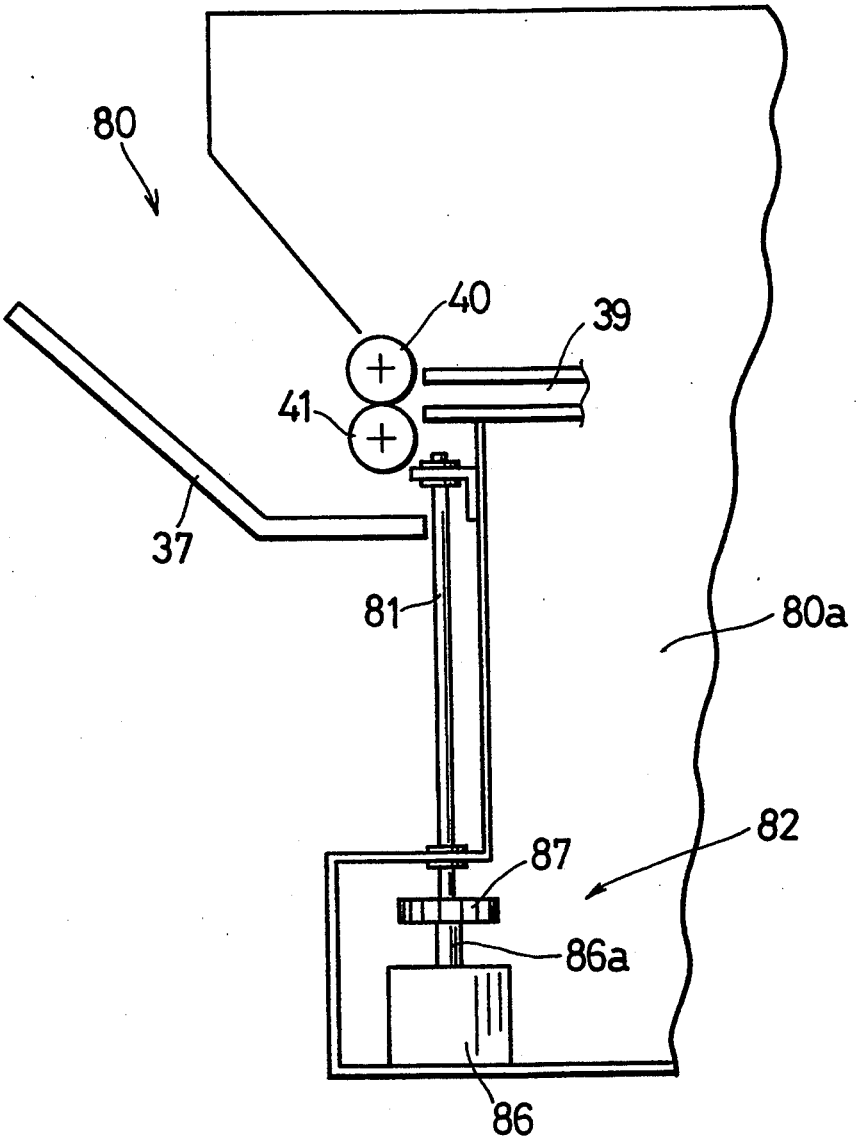
FIG. 9 is a schematic longitudinal sectional view showing the structure of a classifying tray apparatus of still another embodiment in accordance with the present invention.
Figure 10:
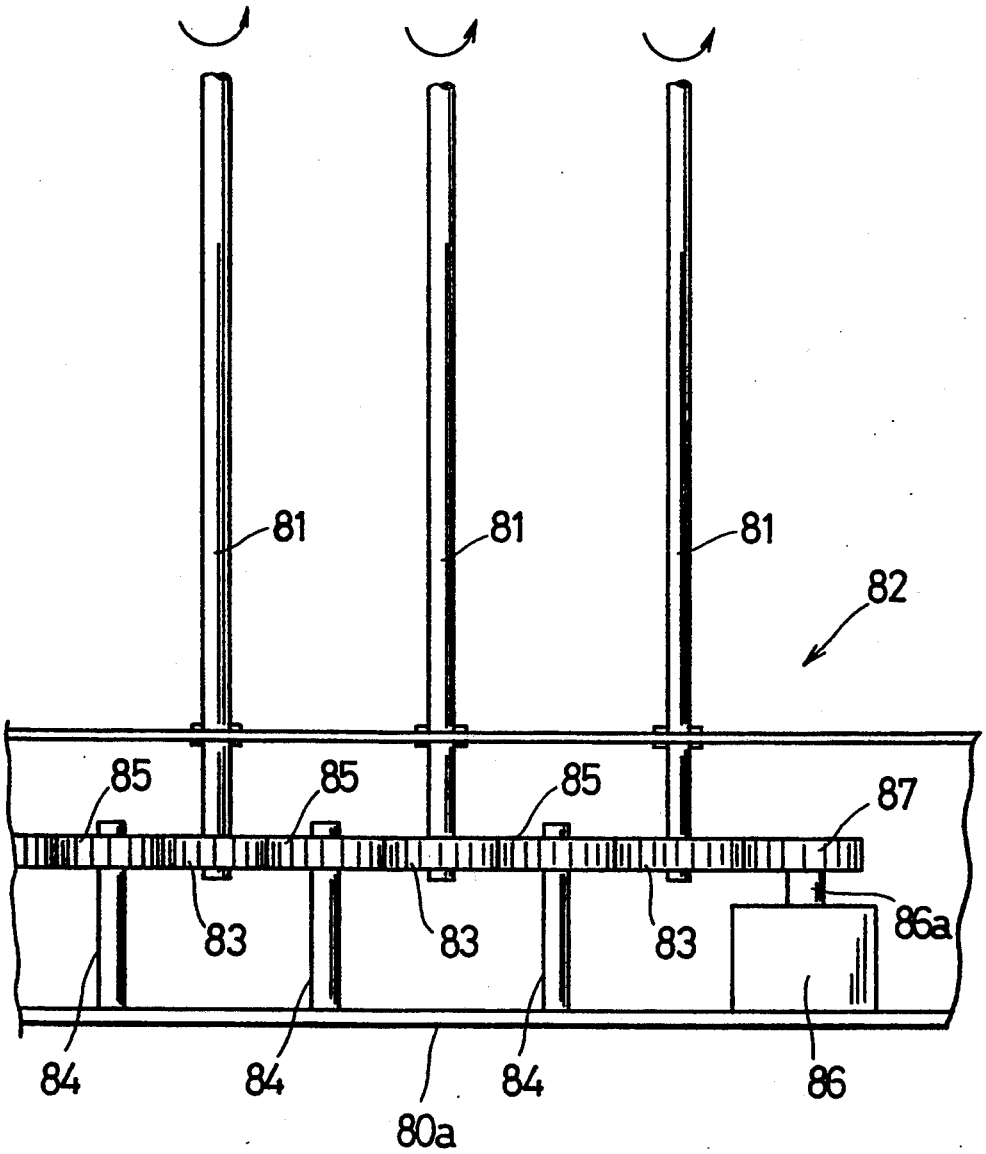
FIG. 10 is a longitudinal sectional view showing a driving mechanism of sheet end receiving rollers.

The following description deals with further embodiment in accordance with the present invention with reference to FIGS. 9 and 10. Note that the same reference numerals are given to the members which have the similar functions to those of the foregoing embodiments, and the detail explanations are omitted.

A classifying tray apparatus 80 of the present embodiment, as shown in FIG. 9, is provided on a rear end side of a sheet discharge tray 37 with a plurality of sheet end receiving rollers 81 for arranging each rear end of the stacked sheets S. Lower end portion of the sheet end receiving rollers 81 is provided with a driving means 82 for driving each sheet end receiving roller 81 so as to rotate. The driving means 82 is composed of gears 83 which are provided in each lower end portion of the sheet end receiving rollers 81, idle gears 85 for engaging the gears 83 which are provided in a classifying tray apparatus main body 80*a* through a shaft 84, a driving motor 86 which is provided in a lower portion of the classifying tray apparatus main body 80*a*, and a motor gear 87 fixed to a motor shaft 86*a* of the driving motor 86 which engages one end of the gears group (see FIG. 10). The respective sheet end receiving rollers 81 simultaneously rotate in response to the driving force of the driving motor 86.

A control section 50 has a synchronizing drive function (not shown) wherein a driving control is carried out with respect to the driving motor 86 such that the sheet end receiving rollers 81 rotate in synchronization with the horizontal movement of the sheet discharge tray 37 in a right-to-left direction.

The sheet end receiving rollers 81, with which the rear end of the sheet S comes into contact, are drived so as to rotate in synchronization with the horizontal movement of the sheet discharge tray 37 in a right-to-left direction, i.e., in synchronization with the horizontal movement of the stacked sheets S. Since no resistance, which is derived from the sheet end receiving rollers 81, is given to the moving of sheet S in the right-to-left direction, thereby smoothly moving the sheet S. As a result, it is avoidable that unevenness occurs among the sheets S. Note that other arrangements and operations are similar to those of the foregoing embodiments.

Figure 11:
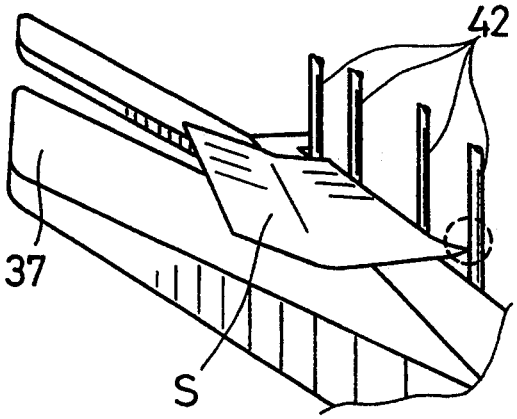
FIG. 11 is a perspective view showing a state where the sheet rear end enters between the sheet end receiving rollers.
Figure 15:
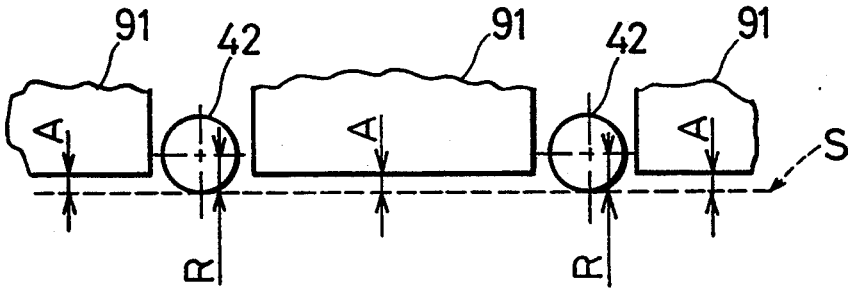
FIG. 15 is an explanatory diagram showing an arrangement of a cover with respect to the sheet end receiving rollers.

The following description deals with still further embodiment in accordance with the present invention with reference to FIGS. 11 and 15. Note that the same reference numerals are given to the members which have the similar functions to those of the foregoing embodiments, and the detail explanations are omitted.

Figure 13:
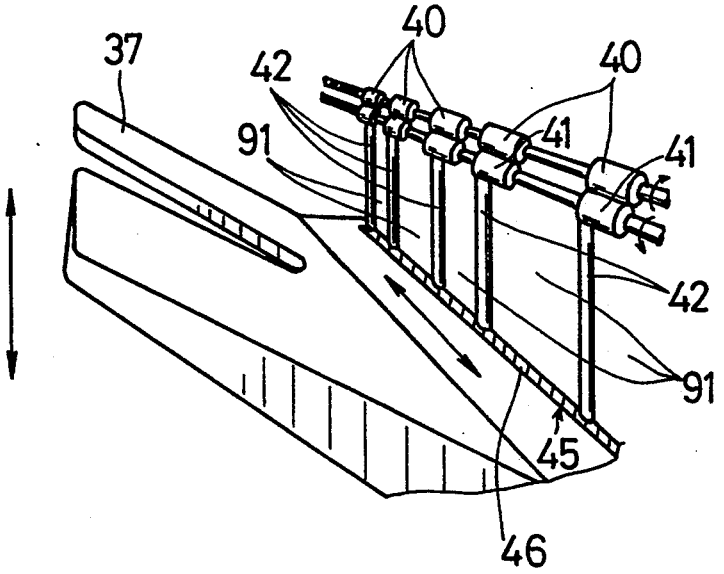
FIG. 13 is a perspective illustration showing a sheet discharge tray and sheet end receiving rollers of the fourth embodiment.

A classifying tray apparatus 90 of the present embodiment, as shown in FIG. 13, is provided with covers 91 between every adjoining sheet end receiving rollers 42 for the purpose of avoiding that (1) unevenness of sheets S occurs due to entering of a rear end of the sheet S into a space between the adjoining sheet end receiving rollers 42 (see FIG. 11) and (2) the sheet S is caught by the sheet end receiving rollers 42.

Figure 12:
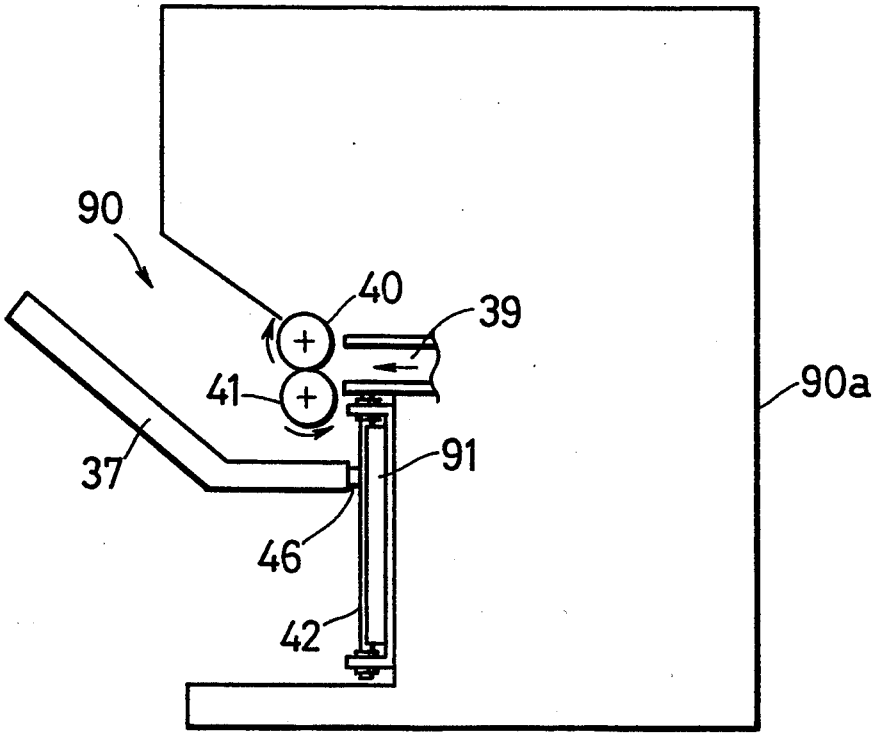
FIG. 12 is a longitudinal sectional view showing the structure of a classifying tray apparatus of another embodiment in accordance with the present invention.
Figure 14:
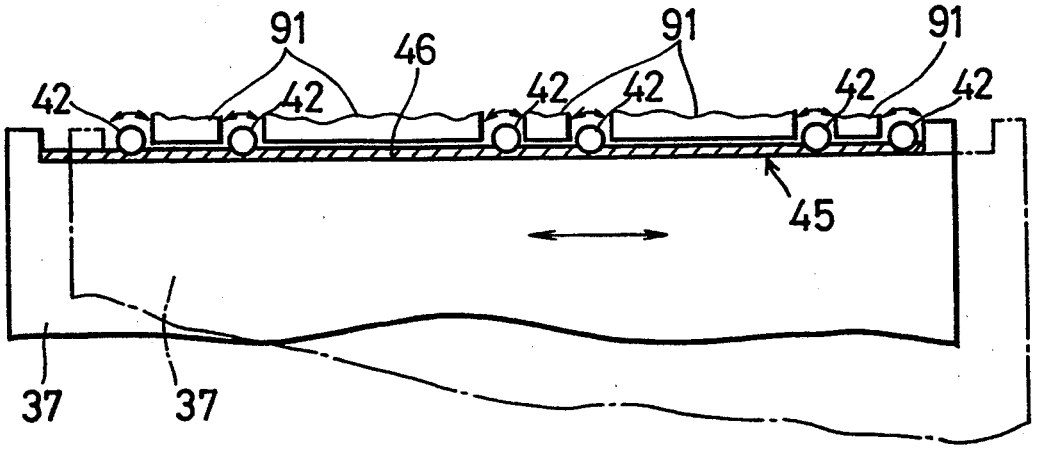
FIG. 14 is a plan view showing a state where the sheet discharge tray moves in a right-to-left direction.

Each cover 91 is provided in a classifying tray apparatus main body 90*a* in an up-and-down direction pararrel to the sheet end receiving rollers 42 (see FIGS. 12 through 14). As shown in FIG. 15, the cover 91 is provided so as to retreat with respect to the sheet end receiving rollers 42. A distance A, between the cover 91 and the rear end portion of the sheet S with which the sheet end receiving rollers 42 come into contact, is smaller than a radius R of each sheet end receiving roller 42. Namely, the cover 91 is provided in a position in which the relation $O<A<R$ is satisfied.

With the arrangement, when the rear end portion slightly deviates so as to be caught between the sheet end receiving rollers 42 during the movement of the sheet discharge tray 37 in the right-to-left direction, the rear end portion of sheet S comes into contact with the cover 91.

Thereafter, the deviation of sheet S is corrected by the next sheet end receiving roller 42 so as to return to the normal state. Thus, it can be avoided that (1) the unevenness of sheets S occurs due to entering of a rear end of the sheet S into a space between the adjoining sheet end receiving rollers 42 and (2) the sheet S is caught by the sheet end receiving rollers 42. Since the cover 91 is provided so as to retreat with respect to the sheet end receiving rollers 42, no resistance is given to the sheets S which horizontally move, thereby ensuring that the sheets S smoothly move during the horizontal movement of the sheet discharge tray 37. Note that other arrangements and operations are similar to those of the foregoing embodiments.

Figure 16:
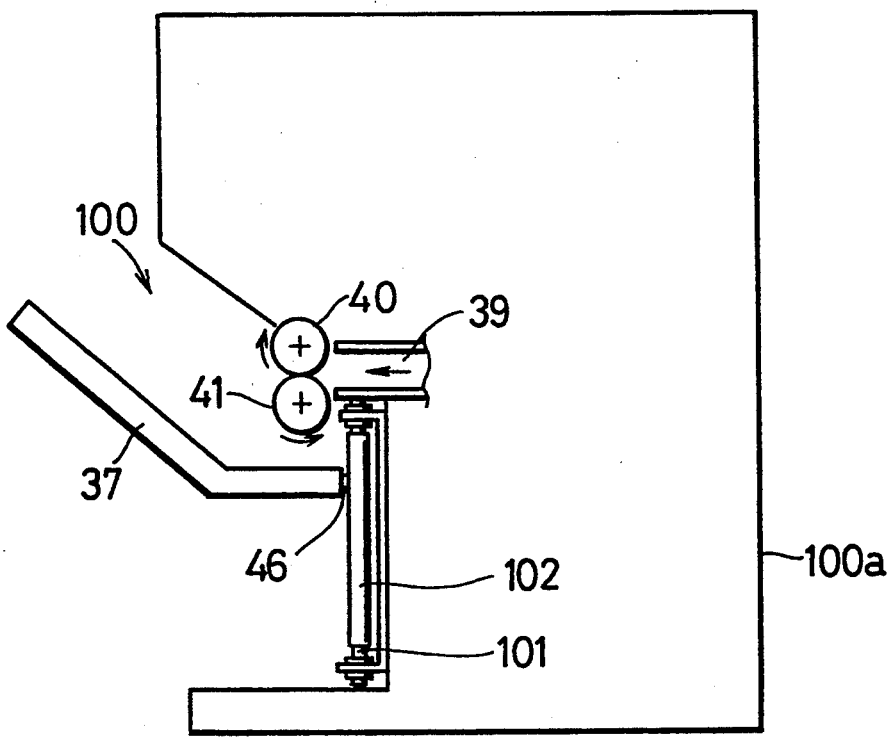
FIG. 16 is a longitudinal sectional view showing the structure of a classifying tray apparatus of further embodiment in accordance with the present invention.
Figure 17:
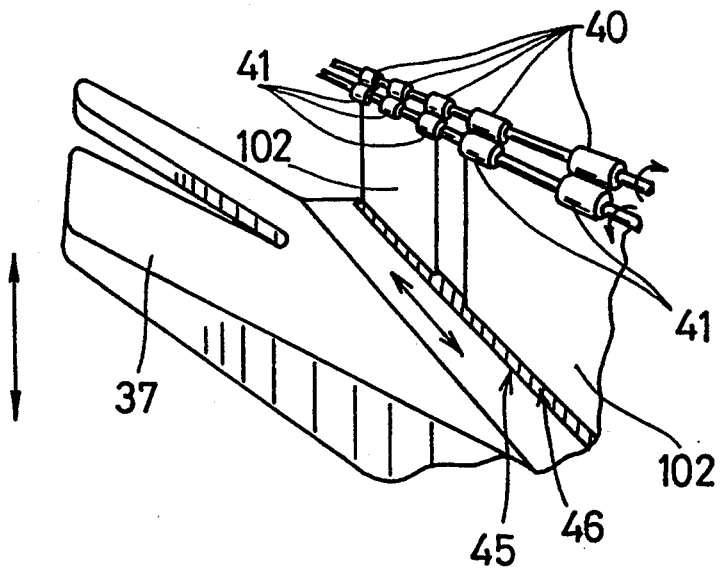
FIG. 17 is a perspective illustration showing a sheet discharge tray and endless belt of the fifth embodiment.
Figure 18:
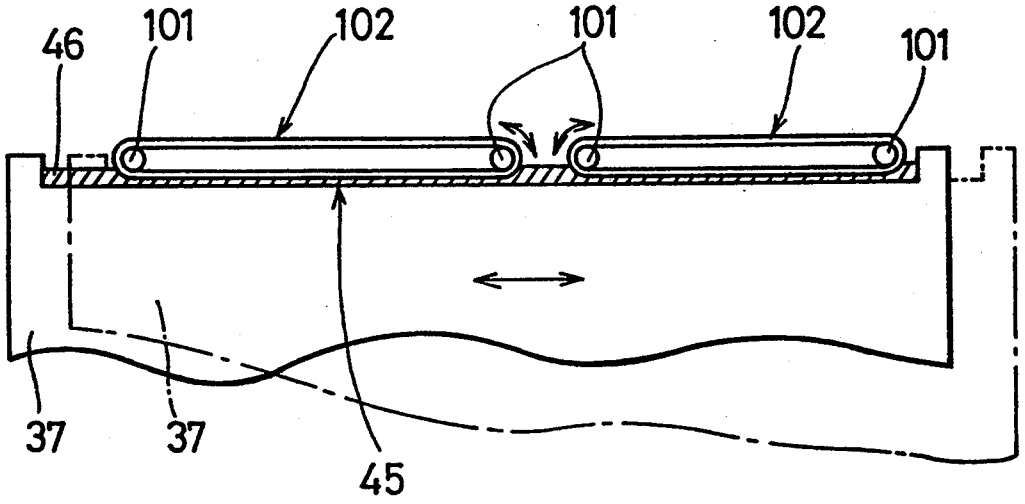
FIG. 18 is a plan view showing a state where the sheet discharge tray moves in a right-to-left direction.

The following description deals with another embodiment in accordance with the present invention with reference to FIGS. 16 through 18. Note that the same reference numerals are given to the members which have the similar functions to those of the foregoing embodiments, and the detail explanations are omitted.

In a classifying tray apparatus 100 of the present embodiment, as shown in FIGS. 16 through 18, four sheet end receiving rollers 101 are provided so as to rotatably stand on a classifying tray apparatus main body 100*a*, each of the four sheet end receiving rollers 101 having its axial direction coincident with an up-and-down direction. There are provided two endless belts 102 in the right and left, each endless belt 102 being bridged over the respective two sheet end receiving rollers 101.

Each endless belt 102 is movable in a right-to-left direction so as to rotate while being in contact with a cushion 46 of the sheet discharge tray 37 in accordance with the horizontal movement of the discharge tray 37 in the right-to-left direction. So, no resistance, which is derived from the endless belt 102, is given to the movement of sheet S in the right-to-left direction, thereby ensuring that the sheet S smoothly moves. Note that other arrangements and operations are similar to those of the foregoing embodiment.

As mentioned above, since the endless belt 102 is bridged over the two sheet end receiving rollers 101, it can be avoided (1) that the rear end portion of the sheet S is caught between the sheet end receiving rollers 101, and (2) that the required number of sheet end receiving rollers is reduced.

Further, since the rear end portion of sheet S comes into area-contact with the endless belt 102, the damage in the rear end portion of the sheet S becomes smaller than that of the case where the rear end portion of sheet S comes into point-contact with the sheet end receiving roller, thereby resulting in that the rear end portion of sheet S is hard to be damaged.

Note that the present invention is not limited to the foregoing embodiments and that many modifications and changes can be added to the foregoing embodiments within the scope of the present invention.

Figure 19:
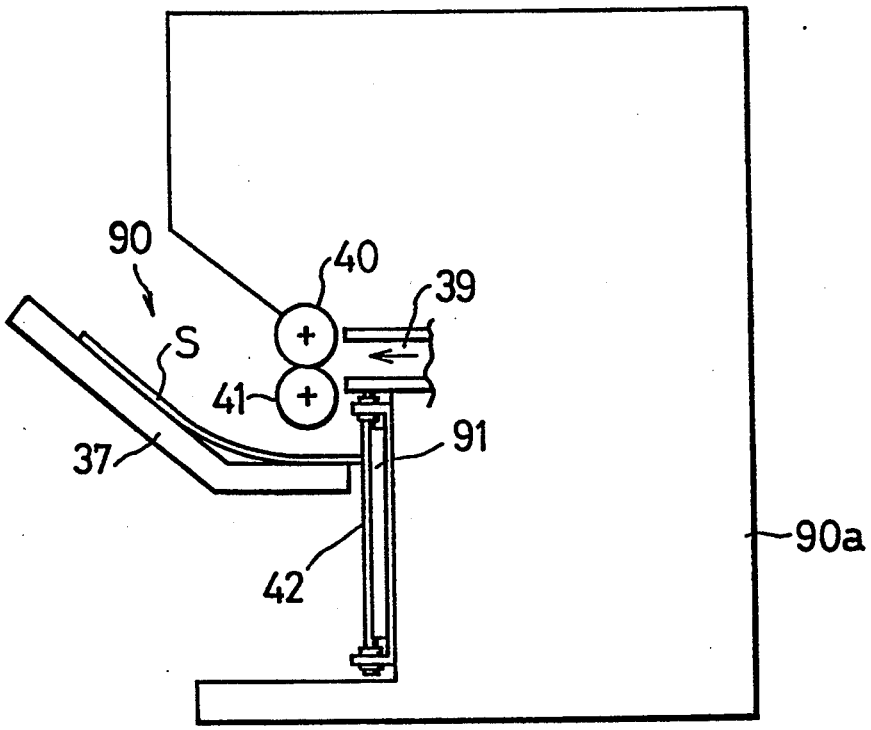
FIG. 19 is a schematic longitudinal sectional view showing the structure of a case where a cover is adapted to the classifying tray apparatus of the second embodiment.
Figure 20:
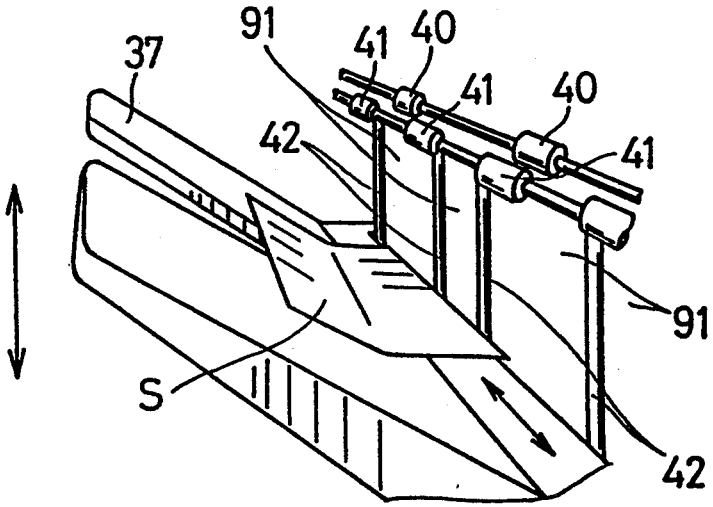
FIG. 20 is a schematic longitudinal sectional view showing the structure of a sheet discharge tray and sheet end receiving rollers of a case where a cover is adapted to the classifying tray apparatus of the second embodiment.
Figure 21:
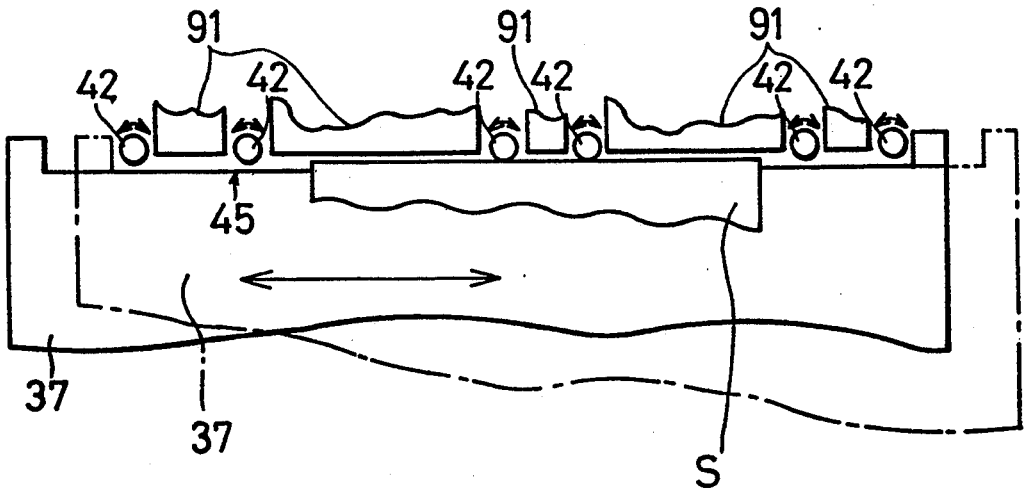
FIG. 21 is a plan view showing a state when the sheet discharge tray moves in a case where a cover is adapted to the classifying tray apparatus of the second embodiment.

For example, as shown in FIGS. 19 through 21, the covers of FIG. 12 may be adapted to the sheet end receiving rollers 42 and 81 of the respective second and third embodiments. The endless belt 102 of the fifth embodiment may be adapted to the respective second and third embodiments.

There are described above novel features which the skilled man will appreciate give rise to advantages. These are each independent aspects of the invention to be covered by the present application, irrespective of whether or not they are included wihtin the scope of the following claims.

What is claimed is:

1. A classifying tray apparatus comprising:

discharge means for discharging sheets;

a sheet discharge tray, provided under said discharge means, for stacking the sheets discharged from said discharge means, said sheet discharge tray having a shape inclined upward in a discharge direction of the sheet;

a plurality of sheet end receiving rollers for respectively arranging each rear end portion of the sheets stacked on said sheet discharge tray; and moving means for horizontally moving said sheet discharge tray in a direction perpendicular to the discharge direction of the sheet, wherein each of said sheet end receiving rollers rotatably stands on a classifying tray apparatus main body so that an axial direction of said each sheet end receiving roller coincides with an up-and-down direction, and rotates while being in contact with one of said sheet discharge tray and the stacked sheets, in accordance with horizontal movement of said sheet discharge tray by said moving means.

2. The classifying tray apparatus as set forth in claim 1, wherein said sheet discharge tray is provided, on said classifying tray apparatus main body side in the discharge direction of the sheet, with an elastic member which moves while being in contact with said sheet end receiving rollers.

3. The classifying tray apparatus as set forth in claim 1, further comprising elevating means for elevating said sheet discharge tray along said sheet end receiving rollers.

4. The classifying tray apparatus as set forth in claim 3, further comprising detecting means for detecting a distance between a top sheet stacked on said sheet discharge tray and a follow-up roller for discharging the sheets, wherein said sheet discharge tray is elevated by said elevating means in accordance with a result detected by said detecting means such that a falling distance of the discharged sheet is kept constant.

5. The classifying tray apparatus as set forth in claim 1, wherein said sheet end receiving rollers are provided under a discharge side of said discharge means.

6. The classifying tray apparatus as set forth in claim 1, further comprising covers which are provided between said sheet end receiving rollers, each of said covers having a length substantially equal to an axial length of said sheet end receiving roller and having a width substantially equal to a distance between an adjoining two of said sheet end receiving rollers.

7. The classifying tray apparatus as set forth in claim 6, wherein said cover is located such that a distance A, between said cover and the rear end portion of the sheet with which said sheet end receiving rollers come into contact, is smaller than a radius R of said sheet end receiving roller.

8. The classifying tray apparatus as set forth in claim 1, further comprising a belt which is bridged over an adjoining two of said sheet end receiving rollers.

9. A classifying tray apparatus comprising:

discharge means for discharging sheets;

a sheet discharge tray, provided under said discharge means, for stacking the sheets discharged from said discharge means, said sheet discharge tray having a shape inclined upward in a discharge direction of the sheet;

a plurality of sheet end receiving rollers for respectively arranging each rear end portion of the sheets stacked on said sheet discharge tray;

moving means for horizontally moving said sheet discharge tray in a direction perpendicular to the discharge direction of the sheet;

driving means for rotating said sheet end receiving rollers; and a control section for controlling said driving means so as to rotate said sheet end receiving rollers in synchronization with a horizontal movement of said sheet discharge tray, wherein said each sheet end receiving roller rotatably stands on a classifying tray apparatus main body so as to have an axial direction coincident with an up-and-down direction.

10. The classifying tray apparatus as set forth in claim 9, further comprising elevating means for elevating said sheet discharge tray along said sheet end receiving rollers.

11. The classifying tray apparatus as set forth in claim 10, further comprising detecting means for detecting a distance between a top sheet stacked on said sheet discharge tray and a follow-up roller for discharging the sheets, wherein said sheet discharge tray is elevated by said elevating means in accordance with a result detected by said detecting means such that a falling distance of the discharged sheet is kept constant.

12. The classifying tray apparatus as set forth in claim 9, wherein said driving means includes:

gears which are attached to each end portion of said sheet end receiving rollers;

idle gears, which are provided in said classifying tray apparatus main body through a shaft, for engaging said each gear; and a driving motor, which is provided in said classifying tray apparatus main body, for rotating said each sheet end receiving roller through said gears and idle gears.

13. The classifying tray apparatus as set forth in claim 9, further comprising covers which are provided between said sheet end receiving rollers, each of said covers having a length substantially equal to an axial length of said sheet end receiving roller and having a width substantially equal to a distance between an adjoining two of said sheet end receiving rollers.

14. The classifying tray apparatus as set forth in claim 9, wherein said cover is located such that a distance A, between said cover and the rear end portion of the sheet with which said sheet end receiving rollers come into contact, is smaller than a radius R of said sheet end receiving roller.

15. The classifying tray apparatus as set forth in claim 9, wherein said sheet end receiving roller is provided under a discharge side of said discharge means.

16. The classifying tray apparatus as set forth in claim 9, further comprising a belt which is bridged over an adjoining two of said sheet end receiving rollers.

* * * * *